United States Patent [19]

Huang et al.

[11] Patent Number: 4,553,595

[45] Date of Patent: Nov. 19, 1985

[54] METHOD FOR FORMING A GRAVEL PACKED HORIZONTAL WELL

[75] Inventors: Wann-Sheng Huang; Alfred Brown, both of Houston, Tex.

[73] Assignee: Texaco Inc., White Plains, N.Y.

[21] Appl. No.: 616,090

[22] Filed: Jun. 1, 1984

[51] Int. Cl.[4] ..... E21B 43/04

[52] U.S. Cl. ..... 166/278; 166/50; 166/51

[58] Field of Search ..... 166/276, 278, 50, 51

[56] References Cited

U.S. PATENT DOCUMENTS

| | | | |
|---|---|---|---|
| Re. 30,019 | 6/1979 | Lindquist | 166/50 X |
| 2,778,603 | 1/1957 | McCune et al. | 166/278 X |
| 2,928,468 | 3/1960 | Wienands | 166/50 X |
| 3,261,401 | 7/1966 | Karr | 166/51 X |
| 4,296,969 | 10/1981 | Willman | 166/50 X |
| 4,442,896 | 4/1984 | Reale et al. | 166/278 |
| 4,442,901 | 4/1984 | Zison | 166/50 X |

FOREIGN PATENT DOCUMENTS

| | | | |
|---|---|---|---|
| 870527 | 3/1953 | Fed. Rep. of Germany | 166/50 |
| 190870 | 7/1957 | Fed. Rep. of Germany | 166/278 |

OTHER PUBLICATIONS

Ranney, Leo, "The World's Largest Water Well", Am. Waterworks Assn., 1938.

*Primary Examiner*—George A. Suchfield

*Attorney, Agent, or Firm*—Robert A. Kulason; James J. O'Loughlin; Robert B. Burns

[57] ABSTRACT

Method for forming a gravel pack in-situ about a horizontal well in a sandy formation. The gravel pack is formed in two separate steps so that part of the pack will function as a foundation for slidably inserting and supporting the well liner. Thereafter, the remainder of the pack is completed about the liner by introducing a gravel slurry that accumulates on the foundation and about the liner.

8 Claims, 8 Drawing Figures

FIG. 1
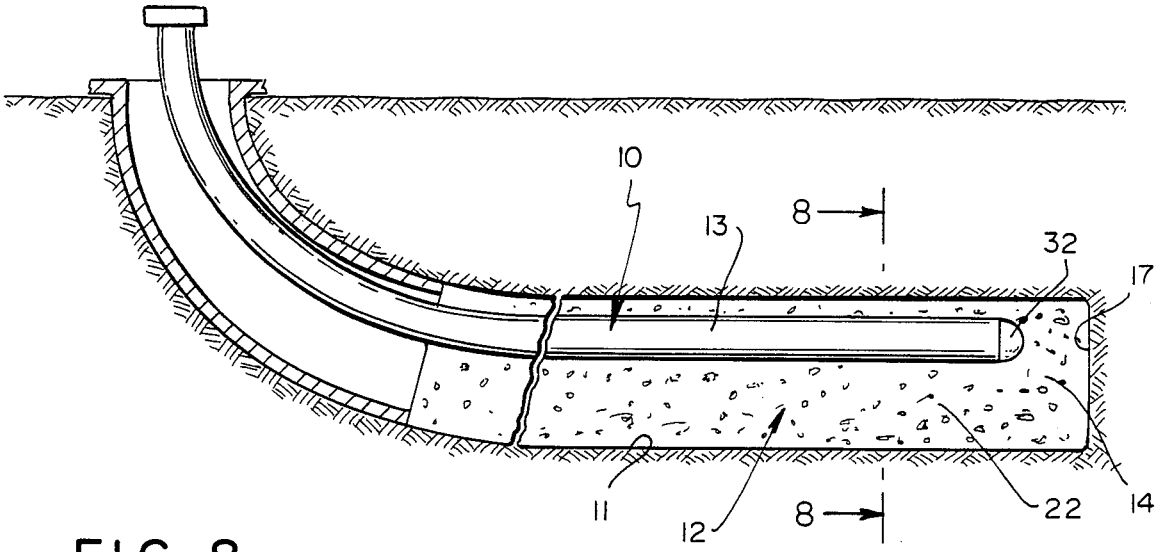
FIG. 8
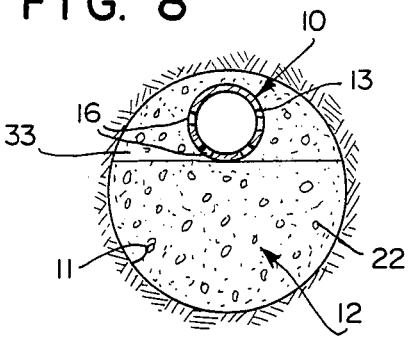
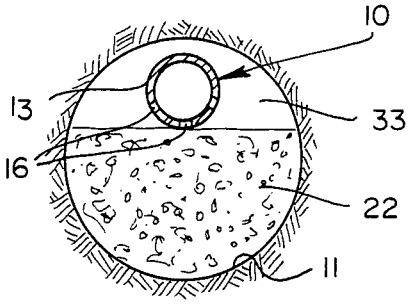
FIG. 2
FIG. 3
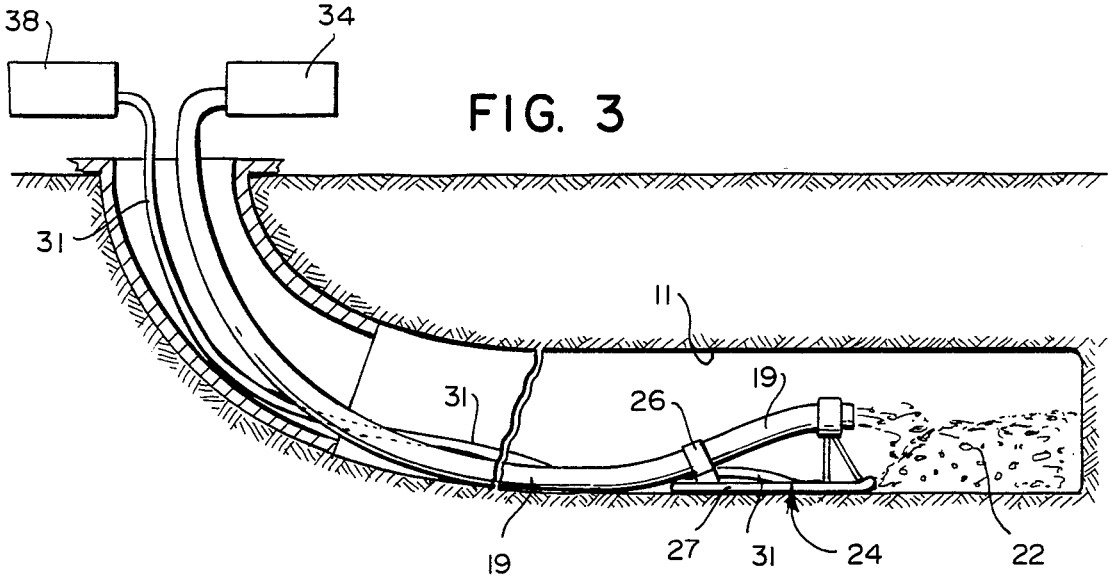

METHOD FOR FORMING A GRAVEL PACKED HORIZONTAL WELL

BACKGROUND OF THE INVENTION

In the production of hydrocarbons, such as crude oil and bitumen, from a subterranean reservoir, the characteristic of the formation has a substantial affect on the efficiency of production. It is expected that in the course of most production operations, the flowing hydrocarbon will carry with it an amount of the substrate from which it is being lifted.

In the instance of a formation comprised largely of unconsolidated sand particles, the flowing hydrocarbon will tend to carry excessive sand with it. The sand thus entering the well casing or liner forms a part of the flow and will eventually have a detrimental effect on the overall operation, as well as on the equipment.

For example, the size of the sand particles could be such that there is a propensity to block or at least partially plug holes and passages through which the flow passes. Further, the abrasive nature of the sand results in the wearing away, or damage to parts which make up the well completion.

Since the combined sand and hydrocarbon flow will have to be treated and separated after being produced, the equipment needed for such separation generally constitutes a major part of the production facility in which sand is a prevalent factor.

It can be appreciated that in the instance of bitumen production from tar sand environment, and the production of viscous crude oil, the problem of sand control can pose a major consideration. In the specific instance of bitumen, the normal thermal stimulation of a substrate through the use of hot fluids such as steam, will tend to promote the flow of sand. As the bitumen or viscous crude is released, the resulting mixture or emulsion will carry along with it, in its flow to the production string, varying sized sand particles.

It has been determined that where the hydrocarbon holding formation constitutes a relatively thin subterranean layer, there are advantages in using horizontal wells. The latter, for example, extend concurrently with the productive layer and can be more economical than a series of vertical wells, all of which pass through the layer at spaced apart points. In the instance of a horizontal well, by stimulating the formation adjacent to the well, the viscous hydrocarbon can be caused to flow and gravitate toward the single well. There it will be produced as a hot mixture or emulsion.

Further, in the instance of horizontal wells which are utilized in tar sands, the problem of excessive sand production in particularly acute. As above noted, the hot bitumen is stimulated and caused to assume a fluid state, thereby carrying with it substantial quantities of sand. The latter will then enter the wall perforations in the horizontally positioned perforated liner. These sand particles will tend to narrow such passages to a minimum opening, or completely obviate flow therethrough.

Efforts have been made through the use of replaceable screens, to minimize this flow of sand into a horizontal producing well. However, the very nature of the well, because it extends horizontally rather than vertically, introduces problems not heretofore contemplated with respect to the in-situ formation of a suitable gravel pack.

Gravel packing is considered the most flexible and prevalent way of minimizing sand production in vertical wells. Such packs are further considered to be of comparable efficiency if they can be adapted to be utilized in conjunction with a horizontal well.

The state of the art relative to in-situ gravel packing of hydrocarbon producing wells covers a broad spectrum of apparatus and methods. Essentially, however, the art is concerned primarily with packing of vertical and/or deviated wells, with open or closed casing. In such wells, gravel injection can be achieved primarily by a gravity flow.

Examples of this type of gravel pack are disclosed in U.S. Pat. No. 4,066,127 and U.S. Pat. No. 4,124,074. In the shown patents, the gravel is introduced through the well and carried into a preformed vertical well cavity whereby to constitute the required sand barrier. This introduction of the gravel is achieved either by feeding the gravel alone, or in the form of a slurry.

In U.S. Pat. No. 2,434,239, the patentee extends the gravel pack concept into a portion of a deviated or sloping well, and even into a portion of a horizontal well. However, the gravel as shown particularly in the patentee's FIG. 3, is introduced to fill the entire borehole. This is achieved by progressively withdrawing the gravel carrying conduit as the borehole fills. The patentee's disclosure lacks the means for providing a gravel pack which surrounds the well liner and forms the necessary peripheral barrier to sand flow.

U.S. Pat. No. 3,261,401 is concerned at least in part with a gravel pack within a horizontal well. The pack in this instance, and as shown in FIGS. 4 and 5, is an integral part of the well liner, and is not installed in-situ.

Toward overcoming the foregoing problems, and for providing an in-situ gravel pack, the disclosed well completion is one that is commenced by first forming an elongated bore. The latter extends substantially horizontally whereby to lie longitudinally through a productive layer or formation.

A perforated well liner or casing, having a diameter substantially less than the diameter of the wellbore, is supportably positioned in the bore in a manner to define an annular passage. Said passage between the casing wall and the adjacent wall of the bore, is furnished with a supporting gravel pack. At least part of the pack supports the liner and is comprised of a gravel size and grade which has been predetermined for the particular formation composition, to best form a barrier to migrating sand particles which would otherwise enter the liner.

The gravel pack is formed in two distinct steps. After the wellbore has been drilled with a horizontal segment, the latter is provided with a foundation bed of unconsolidated gravel. With this support or foundation means in place, the liner is slid along the wellbore for the length of the latter and to its operating position.

Thereafter, the second phase of the gravel pack is achieved by introducing a gravel slurry which is deposited onto the foundation bed, and around the liner.

It is therefore an object of the invention to provide a gravel pack, and method for use thereof in a substrate or formation comprising a sandy composition into which at least one horizontal producing well has been formed.

A further object is to provide a method for forming a gravel pack in situ about a horizontally extending well.

A still further object is to provide a gravel pack and method for applying the same about a well liner that is positioned in a horizontally extending wellbore so that the liner is supported by a gravel foundation.

DESCRIPTION OF THE DRAWINGS

FIG. 1 is a cross-sectional elevation of a gravel packed horizontal well.

FIG. 2 is a cross-sectional view taken along line 2—2 in FIG. 4.

FIGS. 3, 4, and 7 are similar to FIG. 1, showing the progression of installing a gravel pack and line.

FIG. 8 is a cross-sectional view taken along line 8—8 of FIG. 1.

Referring to FIGS. 1 and 8, a well completion 10 of the type contemplated is shown positioned in a generally horizontal disposition within a wellbore 11. The wellbore as noted is formed into a productive formation comprised of a sandy composition.

Normally a producing well of this type is formed by commencing the wellbore 11 at the surface 18, in either a vertical or a downwardly slanted direction. Thereafter, at the productive layer, the well is diverted to extend in a substantially horizontal direction. Preferably, a well of this configuration is employed where the productive formation comprises a relatively thin layer or band. Thus, wellbore 11 can extend for any desired distance along the layer to best direct a thermal stimulating medium for heating the viscous hydrocarbon, and for thereafter carrying away the resulting hydrocarbon emulsion or mixture.

A horizontal well 10 of the type shown in FIG. 1 can be utilized by itself as a production facility for viscous hydrocarbons or bitumen emulsion. Alternatively, a series of horizontally extending wells cooperatively arranged, can be employed to supplement the function of each other through sequential or continuous stimulation and producing steps.

In the present arrangement, and to illustrate the invention, the novel gravel pack 12 and its method of in-situ application will be described with respect to a single, horizontally extending well. The well is formed in a tar sand environment for producing a bitumen emulsion through thermal stimulation by steam injection.

In a normal tar sand layer, the formation is comprised of different sizes of sand particles with the bitumen retained between the particles. The bitumen, however, is initially too thick or viscous to flow without some form of thermal stimulation designed to reduce its viscosity.

Figure 5:
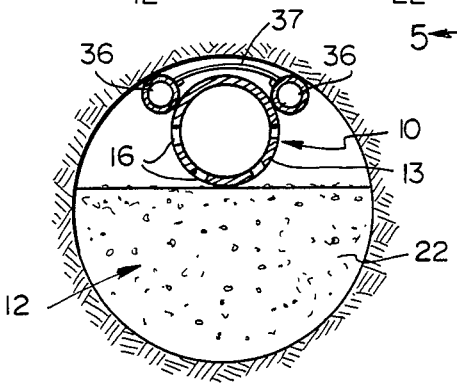
FIG. 5 is a cross-sectional view taken along line 5—5 of FIG. 4.

Horizontal wellbore 11 is provided with a liner or casing 13 which is positioned therein. The latter serves the dual purpose of introducing a heating medium to the surrounding substrate, and producing the resulting bitumen emulsion. Liner 13 is therefore provided as shown in FIGS. 2, 5 and 8, with openings such as perforations or slots 16 formed in the wall thereof. The latter are of a size capable of permitting a pressurized outflow of the heating medium such as steam, and a resulting inflow of hot bitumen emulsion when steam injection is discontinued.

As herein mentioned, inflowing bitumen often carries with it substantial amounts of sand particles in varying sizes. These will accumulate and tend to clog or at least impair flow through the relatively constricted liner wall openings or perforations 16.

These openings could as a practical matter be made larger to accommodate the flow of sand without promoting a blocking action. However, the excessive sand build-up would soon function to clog or impair operation of equipment downstream of liner 13, such as pumps, separators, and the like.

Elongated well liner 13 is supported within wellbore 11 to best achieve the desired filtering action and to minimize sand flow through the liner perforations. Thus, and as shown in FIGS. 1 and 2, in one embodiment liner 13 is positioned adjacent to or contiguous with the upper wall of wellbore 11. The subsequently installed gravel pack 12 will thereby fill the annulus defined by the adjacent walls of said liner and wellbore.

As further shown in FIG. 2, to achieve maximum filtering action liner 13 can be provided with slots or openings 16 for only a portion of the wall periphery. These are arranged adjacent to the lower side or wall of the liner. Inflowing bitumen emulsion will thus be caused to pass through the thicker portions of gravel pack 12 and thereby sustain the desired sand filtering action prior to bitumen emulsion entering the liner wall.

Gravel pack 12 as shown, is installed in two stages in a manner that gravel will fill the forward space 14 of wellbore 11 between the bore remote end wall 17, and the end of liner 13 through which the produced bitumen emulsion can be expected to enter.

Operationally, the initial step in gravel packing any well is to determine the optimal size or size range of the gravel to be used. This is normally established through core tests of the formation through which the horizontal well is to be formed. Further testing will thereafter determine the optimal gravel size which will be most effective in minimizing the amount of sand which passes from the formation and into liner 13 interior.

The carrier for the gravel slurry or flow is preferably an inexpensive liquid and more preferably water. However, depending on the conditions of the formation about liner 13, an appropriate liquid mixture can be made to carry the gravel. It is appreciated that in introducing the gravel slurry into wellbore 11, the slurry will have to be under pressure depending on the length of the well and its inclination, if any, to the horizontal.

After establishing the proper gravel slurry mix which is to be injected into the well, slurry carrying conduit 19 is first pushed into the wellbore 11 from surface 18. Said conduit comprises a continuous length of rigid or flexible metallic pipe or tubing. The conduit is of a sufficient diameter, from about three inches to about six inches, to convey a pressurized slurry flow into the wellbore.

Conduit 19 is preferably made up at the surface of a plurality of individual segments which are connected to form the desired continuous passage. To facilitate insertion of slurry conduit 19, the latter is provided with a plug or nose piece at the forward end. Said plug member will permit pipe 19 to be urged along the length of wellbore 11 without digging in or becoming snagged in such manner as to impede its progress. Upon introduction of the pressurized slurry flow to conduit 19 from pump 34, plug 21 will be displaced from the forward end of the conduit, thereby permitting a free flow of the slurry out into the wellbore.

The volume of gravel slurry which is introduced through slurry conduit 19 is dependent on the volume of the wellbore, and the amount of the gravel bed or foundation 22 which is to be placed within the wellbore.

The lower gravel bed 22 or foundation will build up to a desired height within bore 11. There it will be capable of supporting the subsequently inserted liner 13.

As the slurry discharges, conduit 19 is concurrently withdrawn from the wellbore. The rate of conduit withdrawal from wellbore 11 is contingent on the amount of gravel being deposited. Thus, bed 22 will be progressively laid at the proper height to position liner 13 as desired.

Figure 6:
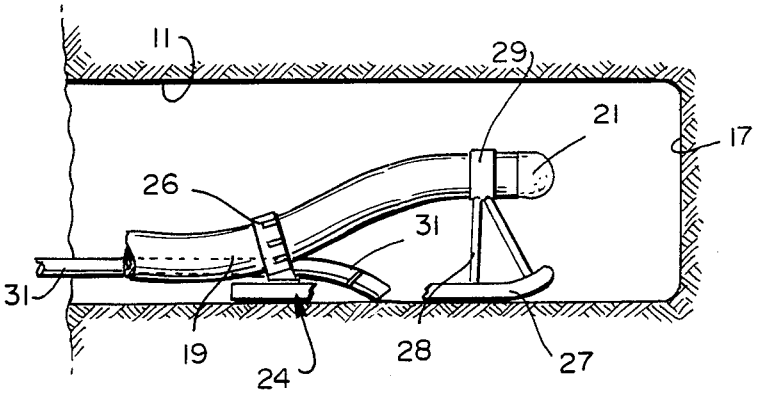
FIG. 6 is an enlarged sectional view taken from FIG. 3.
Figure 7:
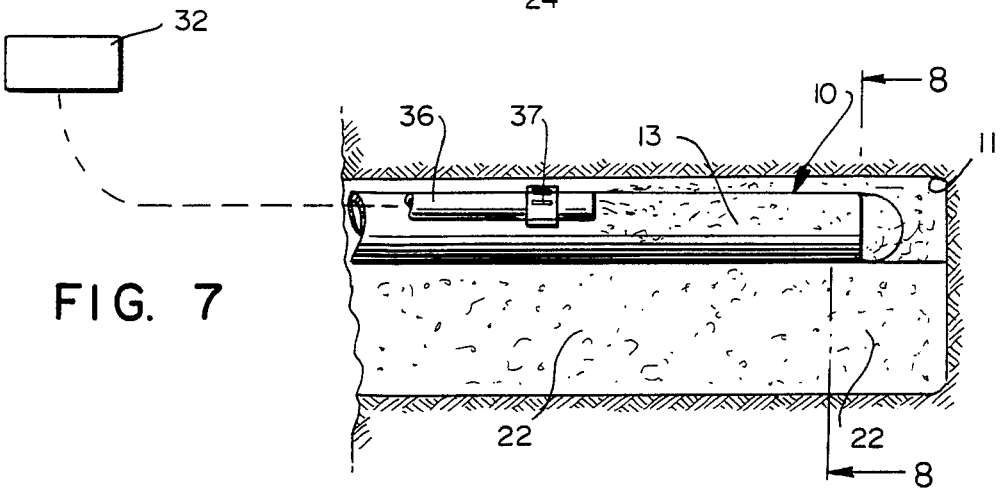

Referring to FIGS. 3 and 6, to facilitate formation of the ultimately laid gravel bed 22, the forward end of slurry conduit 19 can be supplemented with a slide member 24. The latter engages and positions the discharge or forward end of conduit 19 at a desired height within the wellbore, and angled with respect to the wellbore to build up the bed. The latter is preferably built up to a height that will position liner 13 adjacent to the wellbore upper wall.

Slide 24 in one embodiment can include an elongated skid 27 which fixedly engages conduit 19 at a clamp 26. The skid forward end includes an upright column 28 having a second clamp 29 which removably engages the conduit 19 forward end at a proper angle to discharge the slurry.

Thus, as the gravel slurry is discharged from the conduit end, it will be deposited in an unconsolidated pile to form bed 22, thereby causing the progressive building of the latter to a desired height. The latter can occupy from about one-quarter to about three-quarters of the bore volume.

The composition of the formation into which the wellbore 11 is formed may be incapable of absorbing the slurry's liquid carrier. Conductor means is thus provided for aspirating the liquid carrier such as water, which drains into the bottom of the wellbore.

As shown in FIGS. 3 and 6, a water exhaust line 31 can be provided which is connected lengthwise to slurry conduit. Thus, both conduit 19 and the discharge line 31 will be simultaneously withdrawn from the well. As gravel bed 22 is built up, drained water is concurrently removed from the wellbore through line 31 and water pump 38.

Over a period of time, slurry conduit 19 will be withdrawn to the point where gravel bed 22 extends from the wellbore forward end, to a desired position at the rear end. Preferably, gravel pack 12 will terminate where wellbore 11 enters the bore's cased portion, if indeed the well is cased.

With slurry bed or foundation 22 in place, liner 13 is positioned to be inserted into wellbore 11 in supported relation to the gravel bed 22. The forward end of the liner 13 is thereby fitted with a nose piece 32 to facilitate its sliding insertion along the gravel bed upper surface. Nose piece 32 is preferably mixed such that it will readily slide through the wellbore supported on the gravel foundation without becoming snagged or otherwise hung up.

Figure 4:
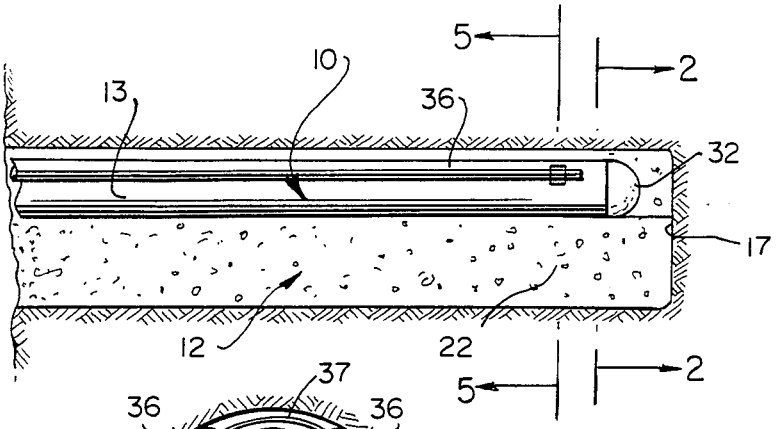

Referring to FIGS. 4 and 5, to facilitate the deposition of the second portion, or cap 33 of gravel bed 12, liner 13 is provided with means to removably engage one or more secondary slurry conduits 36 and 36'. The latter as shown are slidably supported on the liner upper surface adjacent the end of the latter. Thus, when liner 13 is slidably advanced to its forward position within wellbore 11, and the flow of gravel slurry commenced through the secondary slurry conduits 36 and 36', the latter can be progressively withdrawn from the wellbore as the gravel pack is completed.

Said secondary slurry conduits 36 and 36' as shown in FIG. 5 are preferably positioned one on each side of liner 13. The respective conduits are mutually connected through a common bracket 37 which is pulled along the liner upper surface. By discharging dual flows of gravel slurry, the lateral spaces around opposed sides of the liner are progressively filled. The remainder of gravel pack 12 will thereby extend from bed 22, to the top wall of wellbore 11 to completely enclose liner 13.

As gravel pack 12 completes the sand barrier about liner 13, the two secondary discharge conduits 36 and 36' are progressively withdrawn. This rate of withdrawal as herein mentioned is contingent primarily on the amount of gravel to be deposited. The rate of withdrawal can also be monitored by pressure sensing means which transmits a signal to slurry pump 34 indicating an excessive back pressure. Such a signal would indicate that the gravel pack is completed and conduit 36 should be withdrawn at a greater rate.

As the conduit 19 and line 31 are withdrawn toward surface 18, they are disconnected into pipe segments and stored.

Although modifications and variations of the invention can be made without departing from the spirit and scope thereof, only such limitations should be imposed as are indicated in the appended claims.

We claim:

1. Method for forming a gravel packed, horizontal well completion in a hydrocarbon productive subterranean formation comprised of unconsolidated sand particles which hold a viscous hydrocarbon, whereby to minimize the amount of said sand particles carried from the formation when the hydrocarbon is thermally stimulated and produced, which method includes the steps of;

forming a wellbore into the formation substrate and deviating said wellbore to form a substantially horizontal segment when the bore lies within the productive formation, depositing a gravel foundation in the horizontal segment of said wellbore to occupy only the lower portion thereof, while leaving the upper portion unoccupied, longitudinally inserting an elongated well liner along said gravel foundation to be supported by the latter in the unoccupied upper portion of the wellbore, and depositing a second flow of gravel slurry into the unoccupied upper portion of said wellbore horizontal segment, whereby gravel from the said slurry will fill the wellbore upper portion above said gravel foundation and enclose the liner within a gravel pack.

2. In the method as defined in claim 1, wherein said gravel foundation occupies a volume within the wellbore between about one-quarter and three-quarters of the wellbore cross-sectional area.

3. In the method as defined in claim 1, wherein said gravel foundation occupies by volume about one-half of the cross-sectional area of said wellbore horizontal segment.

4. In the method as defined in claim 1, wherein said gravel foundation is formed by inserting a gravel slurry conduit into the wellbore for the entire length of the latter, and directing a flow of gravel slurry through said conduit for deposition thereof in to the wellbore upper portion, as the conduit is progressively withdrawn from the wellbore.

5. In the method as defined in claim 4, including the step of;

regulating the volume of said gravel slurry which enters the wellbore upper portion, in accordance with the rate at which the slurry conduit is withdrawn therefrom.

6. In the method as defined in claim 1, including the step of;

introducing a second gravel slurry conduit into said wellbore concurrently with the insertion of said elongated well liner along said gravel foundation and into the wellbore.

7. In the method as defined in claim 6, wherein said second gravel slurry conduit is releasably attached to the elongated well liner as the latter is slidably inserted into the wellbore.

8. In the method as defined in claim 1, wherein said second flow of gravel slurry is concurrently introduced along opposed sides of the liner.

* * * * *